United States Patent [19]

Kohyama

[11] 4,360,261

[45] Nov. 23, 1982

[54] EXPOSURE APPARATUS FOR COPYING MACHINES

[75] Inventor: Mitsuaki Kohyama, Higashikure, Japan

[73] Assignee: Tokyo Shibaura Denki Kabushiki Kaisha, Kawasaki, Japan

[21] Appl. No.: 176,096

[22] Filed: Aug. 7, 1980

[30] Foreign Application Priority Data

Aug. 14, 1979 [JP] Japan ..... 54/103264

[51] Int. Cl.[3] ..... G03G 15/04

[52] U.S. Cl. ..... 355/3 R; 355/14 E; 355/71

[58] Field of Search ..... 355/3 R, 14 E, 30, 71

[56] References Cited

U.S. PATENT DOCUMENTS 3,743,405 7/1973 Morse et al. ..... 355/3 R 4,095,884 6/1978 Okamoto et al. ..... 355/3 R

FOREIGN PATENT DOCUMENTS 54-22305 2/1979 Japan .

55-36832 3/1980 Japan ..... 355/71

*Primary Examiner*—J. V. Truhe

*Assistant Examiner*—Keith E. George

*Attorney, Agent, or Firm*—Schuyler, Banner, Birch, McKie & Beckett

[57] ABSTRACT

An exposure apparatus for copying machines comprises a light guiding unit having a variable aperture for guiding a light image through the aperture and onto a photoconductive drum. The light guiding unit comprises a thermally metamorphic member positioned near the drum and operatively connected to the variable aperture for controlling the size of the aperture as a function of the temperature of the photoconductive drum.

5 Claims, 4 Drawing Figures

EXPOSURE APPARATUS FOR COPYING MACHINES

BACKGROUND OF THE INVENTION

This invention relates to an exposure apparatus for copying machines.

In a typical copying machine a photoconductive member such as a drum is uniformly charged and exposed with a light image from an original document to form an electrostatic image. A developer is applied to the drum to develop the electrostatic image into a visible toner image which is transferred and fixed to a sheet of paper.

It is well known in the electrostatic copying machine field that the charge acceptance of the photoconductive member changes with the temperature of the member. As the charge acceptance varies, the quality of the copy image is affected.

For example, FIG. 1 shows a graph of charge acceptance versus temperature of the photoconductive member for constant luminance. This data was obtained by charging an amorphous selenium photoconductive member with a corona charger under a constant voltage condition. The ordinate shows the charging potential (V), while the abscissa shows the temperature (T°C.) of the atmosphere surrounding the photoconductive member. The shaded portion is the permissible charging potential region for quality reproduction. It can be seen from this data that the charging potential (V) decreases with temperatures above 30° C.; moreover, temperatures in the region above 40° C. are outside the permissible charging potential range. In other words, with temperature conditions above 40° C. and constant luminance of exposing light, the charging potential (V) corresponds to an excessive exposure; as a result, the copy image quality will be degraded. This is attributable to the fact that the electrical resistance of the photoconductive member is reduced with an increase in temperature; consequently the acceptance of the member for holding electrostatic charges is reduced. It is necessary, therefore, to control the luminance from the exposure lamp which is focused on the photoconductive member.

Japanese Patent Publication (Kokoku) No. 54-22305 (M. Nakaguchi; Aug. 6, 1979) discloses an exposure control device utilized in the prior art containing a thermistor for detecting the temperature of the photoconductive member. A signal representing the detected temperature is then utilized to control the exposure lamp or the size of the aperture which passes the light beam from the exposure lamp. Such prior art devices, however, have many disadvantages such as unreliability, complicated construction and extreme high cost.

SUMMARY OF THE INVENTION

It is an object of the present invention to provide an electrostatic copying machine overcoming the disadvantages of the conventional exposure devices by utilizing a simpler structure.

It is a further object of the present invention to provide an electrostatic copying machine wherein higher quality image reproduction is obtained over a broad temperature range. Appropriate compensation for temperature variations is produced by varying the exposure of the light onto the drum. A thermally metamorphic member operatively connected to a variable aperture controls the size of the aperture as a function of the temperature of the drum.

DETAILED DESCRIPTION OF THE PREFERRED EMBODIMENT

Figure 2:
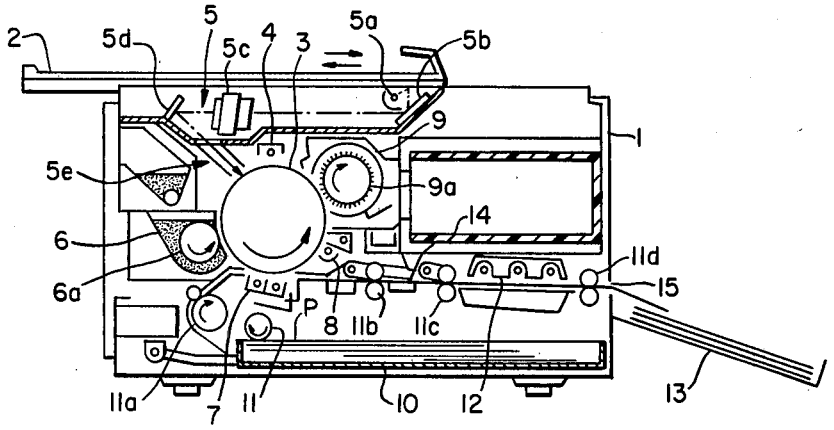
FIG. 2 is a schematic view showing an embodiment of the invention positioned within an electrostatic copying machine.
Figure 3:
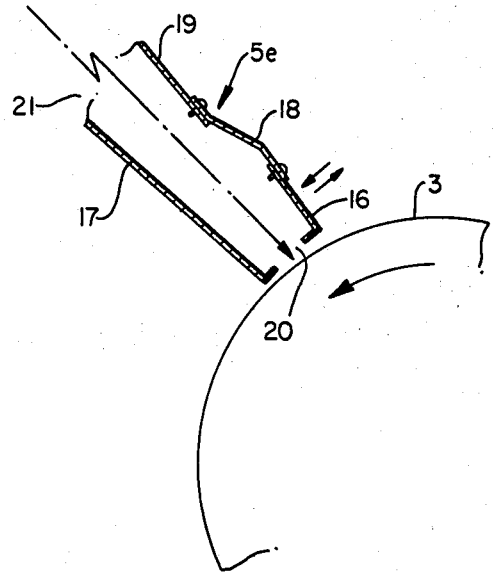
FIG. 3 is an enlarged fragmentary longitudinal sectional view showing one embodiment of the invention; and, FIG. 4 is an enlarged fragmentary longitudinal sectional view showing another embodiment of the invention.

Referring now to FIGS. 2-3, an explanation will be given regarding a preferred embodiment of the invention.

As shown in FIG. 2, the electrostatic copying machine of the invention comprises a photoconductive drum 3, a charger 4, an exposure device 5 and a developing device 6. Photoconductive drum 3 is disposed in a main body 1 and is linked to an appropriate drive means (not shown) to rotate in the direction indicated by the arrow. The photoconductive drum 3 is a photoconductive medium made of amorphous selenium, zinc oxide, etc. A table 2 is reciprocative provided on the main body 1 for holding an original document to be copied. Charger 4 is provided adjacent drum 3 for applying a uniform electrostatic charge to the photoconductive drum 3. The exposure device 5 is positioned at the upper portion of main body 1 for exposing the charged photoconductive drum 3 so as to produce an electrostatic latent image on the drum 3. Exposure device 5 comprises an exposure lamp **5*a*, a first mirror 5*b*, a lens unit 5*c*, a second mirror 5*d* and a light guiding unit 5*e*. The developing device 6 includes a magnetic roller 6*a*** for developing the electrostatic latent image.

Disposed below drum 3 is a transfer charger 7 for transfering the developed image to a sheet of paper P. A corona charge remover 8 is provided adjacent drum 3 for removing the residual charge by applying a corona charge of opposite polarity to the polarity of the electrostatic latent image. A cleaning device 9 is provided adjacent drum 3 for removing the residual toner. This removal is accomplished by the rotation of a fur brush **9*a* against drum 3. A sheet cassette 10 containing sheets of paper is disposed in the lower portion of main body 1. A sheet feed roller 11 contacts each sheet P to begin movement of the sheet along a sheet path 14. Positioned along path 14 are sheet transport rollers 11*a*, 11*b*, 11*c* and 11*d* to maintain movement of the sheet along sheet path 14. A fixing device 12 is provided at the end of the sheet path 14 for fixing the toner image transferred to sheet P from drum 3. A tray 13 is attached at outside of main body 1 and positoned adjacent a sheet outlet 15** for receiving sheet P discharged from the copying machine.

FIG. 3 shows in detail the structure of the light guiding unit **5*e* according to this invention. Unit 5*e* has a variable aperture 20 for guiding the light image onto photoconductive drum 3. The invention comprise means connected to the aperture for controlling the size of the aperture as a function of the temperature of the drum. Light guiding unit 5e comprises a first plate 16, a second plate 17, a thermally metamorphic plate or bimetal plate 18 and a guide plate 19. The second plate 17 is spaced from the first plate 16. The front end of the first and second plate 16, 17 are bent inwardly to define therebetween the slit-like variable aperture 20. The rear end of the first plate 16 is riveted or otherwise connected to the one end of the bimetal member or plate 18. The other end of bimetal plate 18 is riveted or otherwise connected to the front end of guide plate 19. The second plate 17, guide plate 19, bimetal plate 18 and first plate 16 define a light guide path 21 for guiding the light image through the variable aperture 20 and onto the surface of the photoconductive drum 3. The bimetal member 18 consists of invar and bronze plates laminated together by welding. It is adapted so that its free end, which is riveted to the first plate 16, will be bendable due to thermal metamorphosis with respect to its secured point, which is connected to guide plate 19. When the temperature of the photoconductive drum 3 increases, bimetal member 18 will bend clockwise so that the size of aperture 20 will decrease. When the temperature of the photoconductive drum 3 decreases, the bimetal member 18 will bend counterclockwise so that the size of aperture 20 will increase. As a result, the exposure of light incident on the surface of the photoconductive drum 3** will be automatically controlled.

The operation of the electrostatic copying machine of the above construction will now be described. An original document is placed on table 2, and a copying switch (not shown) is turned on. By turning on the copying swtich, the drive unit (not shown) and the photoconductive drum 3 is driven. At this time, the photoconductive drum 3 is uniformly charged by the charger 4. As the table 2 moves towards the right, the exposure lamp 5a lights. As a result, the light image of the original document5d and aperture 20 of light guiding unit 5e. The light is then received onto the charged portion of drum 3 to form an electrostatic latent image. Subsequently, developer is supplied to the electrostatic latent image by the magnetic roller 6a of developing device 6 to form a toner image. The toner image is then transferred by transfer charger 7 onto the sheet P supplied, via sheet feed roller 11 and transport roller 11a, from sheet cassette 10. Thereafter, sheet P is transported by sheet transport rollers 11b, 11c, to fixing device 12 where the toner image is fixed. Upon completion of this step, sheet P is then discharged by roller 11d onto tray 13. Upon completion of the transfer process, the residual charge on drum 3 is removed by corona charge remover 8, and the residual toner on drum 3 is removed by rotary fur brush 9a of cleaning device 9.

Figure 1:
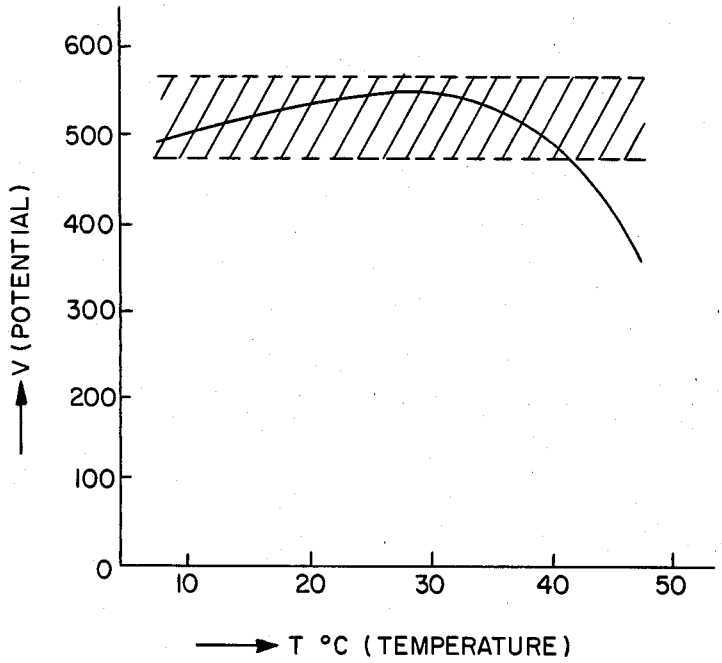
FIG. 1 is a graph showing the charging potential versus the temperature of the photoconductive member.

When the temperature of the atmosphere surrounding photoconductive drum 3 gradually increases during the copying process, the charge acceptance of the drum decreases as shown in FIG. 1. The temperature increase can be due to the atmospheric temperature of the location of the copying machine or the heat generated by the fixing device 12. In any event, as the temperature increases, the bimetal plate 18 is thermally caused to undergo rotational displacement in the clockwise direction about its secured point. This rotational displacement of the bimetal plate 18 thereby reduces the size of the variable aperture 20. with the reduction of the size of the aperture the amount of light traveling through the light guiding unit 5e will be reduced. As a result, the surface of the drum 3 will be exposed with adequately controlled exposure according to the charging potential (V) of the drum 3. Thus, the thermal displacement of bimetal plate 18 will appropriately control the exposure for obtaining uniform quality of the copies over wide temperature variations.

Figure 4:
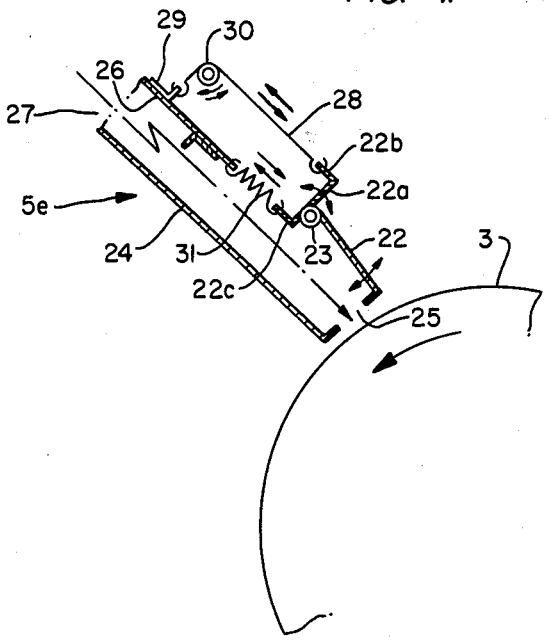

In FIG. 4, another embodiment of a light guiding unit 5e is shown. A first plate 22 having a perpendicularly oriented plate 22a which includes an upper rim 22b and a lower rim 22c. The upper and lower rims 22b, 22c are positioned parallel to the first plate 22. The first plate 22 is pivoted with respect to light guide path 27 about a pivot pin 23. A second plate 24 is spaced from the first plate 22, wherein the spacing between the plates 22, 24 at a position along the plates 22, 24 define a variable aperture 25. That is, the front end of the first and second plates 22 and 24 are bent inwardly to define therebetween a slit-like variable aperture 25. A guide plate 26 is spaced from the first plate 22 and positioned substantially parallel to second plate 24. Guide plate 26 is positioned substantially coaxial with the lower rim 22c of first plate 22 so that a light guide path 27 is formed between plates 26, 22 and plate 24. A thermally metamorphic member or a metallic wire 28 is provided between upper rim 22b and a hook 29 provided on guide plate 26. Wire 28 is connected from the upper rim 22b over a roller 30 and to hook 29. As a result, plate 22 is urged to move in a counterclockwise direction by wire 28. One end of a spring 31 is connected to a front end of guide plate 26 while the other end of spring 31 is connected to the lower rim 22c, so that the plate 22 is biased by spring 31 to move in a clockwise direction. As a result, under normal temperature conditions the tension of spring 31 and metallic wire 28 are balanced, whereby the variable aperture 25 is set for proper reproduction.

The metallic wire 28 has particular thermal expansion and contraction as a function of the change in the temperature of photoconductive drum 3. That is, the length of wire 28 is changed in accordance with its coefficient of thermal expansion. When the temperature of the photoconductive drum 3 increases (e.g. more than 40° C.) the metallic wire 28 will expand. Consequently, first plate 22 will rotate clockwise due to the force exerted by spring 31 and, thereby, reduce the size of aperture 25. Conversely, as the temperature decreases first plate 22 will rotate counterclockwise due to the force exerted by wire 28 and, thereby, increase the size of aperture 25.

I claim:

1. In an electrostatic copying machine having a photoconductive member, charge means for applying a uniform electrostic charge to the photoconductive member, exposure means for exposing the charged photoconductive member to a light image and producing an electrostatic latent image on the photoconductive member, and developer means for developing the electrostatic latent image, said exposure means comprising:

a light guiding means for guiding said light image onto said photoconductive member, said light guiding means including a variable aperture means having at least one movable element for varying the amount of light reaching said photoconductive member, said light guiding means further comprising a thermally metamorphic member positioned near said photoconductive member and attached to said movable element and capable of undergoing physical displacement upon exposure to changes in temperature of said photoconductive member, whereby said movable element undergoes displacement to vary the amount of said light as a function of temperature of the photoconductive member.

2. The electrostatic copying machine of claim 1 wherein said light guiding means comprises a first plate and a second plate spaced from said first plate, wherein the spacing between said plates at a position along said plates defines said aperture, said thermally metamorphic member attached to at least the first plate for moving the first plate with respect to said second plate for controlling the size of said aperture as a function of the temperature of the photoconductive member.

3. The electrostatic copying machine of claim 1 or claim 2 wherein said thermally metamorphic member comprises a bimetal plate.

4. The electrostatic copying machine of claim 1 or claim 2 wherein said thermally metamorphic member comprises a metallic wire.

5. The electrostatic copying machine of claim 4 wherein said light guiding means further comprises a guide plate positioned adjacent to said first plate, said first plate being pivotally movable with respect to said guide plate, a spring means coupled between said first plate and said guide plate for urging the pivotal movement of a first direction; and, said metallic wire being coupled between said first plate and said guide plate for urging the pivotal movement of a second direction opposite to said first direction.

* * * * *